US012492441B2

(12) United States Patent
Kim et al.

(10) Patent No.: US 12,492,441 B2
(45) Date of Patent: Dec. 9, 2025

(54) DENT-RESISTANT COLD-ROLLED STEEL SHEET HAVING EXCELLENT DENT-RESISTANCE PROPERTIES, DENT-RESISTANT PLATED STEEL SHEET, AND METHOD FOR MANUFACTURING SAME

(71) Applicant: Hyundai Steel Company, Incheon (KR)

(72) Inventors: Byoung Jin Kim, Jeollanam-do (KR); Chun Ku Kang, Chungcheongnam-do (KR); Young Ju Park, Jeollanam-do (KR); Ha Young Yu, Seoul (KR); Min Ho Jang, Chungcheongnam-do (KR); Seong Kyung Han, Gyeonggi-do (KR); Sung Yul Huh, Gyeonggi-do (KR)

(73) Assignee: Hyundai Steel Company, Incheon (KR)

( * ) Notice: Subject to any disclaimer, the term of this patent is extended or adjusted under 35 U.S.C. 154(b) by 486 days.

(21) Appl. No.: 17/922,626

(22) PCT Filed: Dec. 21, 2021

(86) PCT No.: PCT/KR2021/019532
§ 371 (c)(1),
(2) Date: Nov. 1, 2022

(87) PCT Pub. No.: WO2022/145857
PCT Pub. Date: Jul. 7, 2022

(65) Prior Publication Data

US 2023/0167519 A1 Jun. 1, 2023

(30) Foreign Application Priority Data

Dec. 29, 2020 (KR) ..... 10-2020-0186457

(51) Int. Cl.
*C21D 8/02* (2006.01)
*C21D 9/46* (2006.01)
(Continued)

(52) U.S. Cl.
CPC ..... *C21D 8/0236* (2013.01); *C21D 8/0226* (2013.01); *C21D 8/0273* (2013.01);
(Continued)

(58) Field of Classification Search
None
See application file for complete search history.

(56) References Cited

U.S. PATENT DOCUMENTS 6,524,726 B1 2/2003 Kitano et al.
7,559,997 B2 7/2009 Nakajima et al.
(Continued)

FOREIGN PATENT DOCUMENTS

JP H 07-305160 A 11/1995
JP 2981629 B2 11/1999
(Continued)

OTHER PUBLICATIONS

Office Action issued Apr. 1, 2024 in corresponding Brazilian Patent Application No. BR112022022312-9 (English translation).
(Continued)

*Primary Examiner* — Jenny R Wu
(74) *Attorney, Agent, or Firm* — Fox Rothschild LLP

(57) ABSTRACT

The present invention provides a dent-resistant cold-rolled steel sheet having excellent dent-resistance properties. According to one embodiment of the present invention, the dent-resistant cold-rolled steel sheet includes, by weight, carbon (C): 0.005% to 0.03%, manganese (Mn): 1.0% to 2.5%, aluminum (Al): 0.2% to 0.8%, sum of chromium (Cr) and molybdenum (Mo): 0.3% to 1.5%, sum of niobium (Nb) and titanium (Ti): 0.001% to 0.01%, phosphorus (P): greater
(Continued)

than 0% to 0.02%, sulfur (S): greater than 0% to 0.01%, and the balance of iron (Fe) and other unavoidable impurities, wherein a yield strength (YP) of 195 MPa or greater, a tensile strength (ST) of 340 MPa or greater, elongation (El) of 33% or greater, and a bake hardening (BH) amount of 40 MPa or greater are satisfied.

15 Claims, 4 Drawing Sheets

(51) Int. Cl.

| | |
|---|---|
| ***C22C 38/00*** | (2006.01) |
| ***C22C 38/04*** | (2006.01) |
| ***C22C 38/06*** | (2006.01) |
| ***C22C 38/22*** | (2006.01) |
| ***C22C 38/26*** | (2006.01) |
| ***C22C 38/28*** | (2006.01) |
| ***C23C 2/40*** | (2006.01) |

(52) U.S. Cl.
CPC ..... *C21D 9/46* (2013.01); *C22C 38/002* (2013.01); *C22C 38/004* (2013.01); *C22C 38/04* (2013.01); *C22C 38/06* (2013.01); *C22C 38/22* (2013.01); *C22C 38/26* (2013.01); *C22C 38/28* (2013.01); *C23C 2/40* (2013.01); *C21D 2211/005* (2013.01); *C21D 2211/008* (2013.01)

(56) References Cited

U.S. PATENT DOCUMENTS

| | | | | |
|---|---|---|---|---|
| 9,567,658 | B2 | 2/2017 | Toda et al. | |
| 11,427,898 | B2 | 8/2022 | Bonnet et al. | |
| 2012/0282487 | A1* | 11/2012 | Ogawa | C23C 2/28 148/333 |
| 2014/0261919 | A1 | 9/2014 | Samuel et al. | |
| 2016/0053340 | A1* | 2/2016 | Park | C22C 38/004 420/104 |
| 2016/0060724 | A1 | 3/2016 | Kang et al. | |

FOREIGN PATENT DOCUMENTS

| | | | |
|---|---|---|---|
| JP | H11310849 | A | 11/1999 |
| JP | 2009270125 | A | 11/2009 |
| JP | 4786521 | B2 | 10/2011 |
| KR | 20040066935 | A | 7/2004 |
| KR | 20120134711 | A | 12/2012 |
| KR | 20150026734 | A | 3/2015 |
| KR | 101607011 | B1 * | 3/2016 |
| KR | 20190137750 | A | 12/2019 |
| RU | 2 389 803 | C2 | 5/2010 |
| RU | 2 552 808 | C1 | 6/2015 |
| RU | 2 717 619 | C1 | 3/2020 |

OTHER PUBLICATIONS

Office Action issued Feb. 19, 2024 in corresponding Indian Patent Application No. 202217062836.
European Search Report issued May 21, 2024 in corresponding European Patent Application No. 21915655.1.
Office Action issued Jun. 20, 2023 in corresponding Russian Patent Application No. 2022127303.

* cited by examiner

DENT-RESISTANT COLD-ROLLED STEEL SHEET HAVING EXCELLENT DENT-RESISTANCE PROPERTIES, DENT-RESISTANT PLATED STEEL SHEET, AND METHOD FOR MANUFACTURING SAME

This application is a National Stage Application pursuant to 35 U.S.C. § 371, of United States International Application No. PCT/KR2021/019532, filed Dec. 21, 2021, which claims priority to Korean n Patent Application No. 10-2020-0186457, filed Dec. 29, 2020. The entire contents of which are incorporated herein by reference in their entirety.

TECHNICAL FIELD

The technical spirit of the present invention relates to a cold rolled steel sheet, and more particularly, to a dent-resistant cold rolled steel sheet having excellent dent resistance properties, a dent-resistant plated steel sheet, and manufacturing methods thereof.

BACKGROUND

Customers who use automotive exterior panels may include into primary customers who produce automobiles and secondary customers who purchase and use automobiles. The primary customers require a material with low yield strength to improve the dimensional accuracy of the panels and prevent shape defects during press forming, and the secondary customers want a material with high yield strength to prevent permanent deformation of the car body exterior such as dents or scratches. Therefore, the exterior panel material for automobiles shows two characteristics having the reduced the yield strength that is beneficial before forming and the increased the yield strength that is beneficial after assembly of the finished vehicle.

Since bake hardening steel manufactured of ultra-low carbon steel has a bake hardening property in which yield strength is low before forming, but yield strength after forming, painting, and drying increases, it satisfies the two characteristics. Therefore, bake hardening steel has been widely used as automotive exterior panels.

The bake hardening property is obtained by utilizing the deformation aging phenomenon, in which the yield strength increases due to the interstitial solute element fixing to the dislocation generated during press forming, as a strengthening mechanism. It has been widely utilized as the main mechanism of improving the dent resistance of the final product along with work hardening by dislocation proliferation during press forming.

There is a method of increasing the amount of solid solution elements in a steel material in order to improve the bake hardenability. However, when the amount of solid solution elements increases, natural aging occurs in the storage process before transporting and press forming the material so that the yield strength may increase, and yield point elongation occurs so that dimensional defects, shape defects, and surface defects may be caused.

PRIOR ART DOCUMENT

Korean Patent Application No. 10-2011-0053831

SUMMARY

Technical Problem

The technical problem to be achieved by the technical spirit of the present invention is to provide a dent-resistant cold rolled steel sheet having excellent dent resistance properties, a dent-resistant plated steel sheet, and manufacturing methods thereof.

However, these tasks are exemplary, and the technical spirit of the present invention is not limited thereto.

Technical Solution

According to one aspect of the present invention, there are provided a dent-resistant cold rolled steel sheet having excellent dent resistance properties, a dent-resistant plated steel sheet, and manufacturing methods thereof.

According to one embodiment of the present invention, the dent-resistant cold rolled steel sheet may include, by weight %, 0.005% to 0.03% of carbon (C), 1.0% to 2.5% of manganese (Mn), 0.2% to 0.8% of aluminum (Al), 0.3% to 1.5% of the sum of chromium (Cr) and molybdenum (Mo), 0.0010% to 0.01% of the sum of niobium (Nb) and titanium (Ti), greater than 0% to 0.02% of phosphorus (P), greater than 0% to 0.01% of sulfur (S), and the balance of iron (Fe) and other unavoidable impurities, and the dent-resistant cold rolled steel sheet has a yield strength (YP) of 195 MPa or greater, a tensile strength (TS) of 340 MPa or greater, an elongation (El) of 33% or greater, and a bake hardening amount (BH) of 40 MPa or greater.

According to one embodiment of the present invention, the sum of chromium and molybdenum may be controlled according to Equation below.

$$0.3\text{ wt }\% \leq [Cr]+0.3[Mo] \leq 1.5\text{ wt }\%.$$

According to one embodiment of the present invention, the dent-resistant cold rolled steel sheet may include a mixed structure in which ferrite and martensite are mixed.

According to one embodiment of the present invention, a fraction of the martensite may be in a range of greater than 0% to 9%, and the ferrite may constitute the remaining fraction.

According to one embodiment of the present invention, the ferrite may have an average crystal grain size in a range of 5 μm to 20 μm.

According to one embodiment of the present invention, the martensite may have an average interphase distance therebetween in a range of 2 μm to 5.5 μm.

According to one embodiment of the present invention, the dent-resistant cold rolled steel sheet may include non-ferrous precipitates, and the non-ferrous precipitates may have an average interparticle distance of 0.05 μm or greater.

According to one embodiment of the present invention, the dent-resistant cold rolled steel sheet may have a yield strength (YP) of 195 MPa to 275 MPa, a tensile strength (TS) of 340 MPa to 490 MPa, an elongation (El) of 33% to 45%, and a bake hardening amount (BH) of 40 MPa to 100 MPa.

According to one embodiment of the present invention, the dent-resistant cold rolled steel sheet may satisfy a work hardening amount of 80 MPa to 200 MPa in a strain range of 2% to 10%.

According to one embodiment of the present invention, the dent-resistant cold rolled steel sheet may have a final yield strength in a range of 350 MPa to 500 MPa after baking hardening and work hardening are performed.

According to one embodiment of the present invention, the yield point elongation may not occur in the dent-resistant cold rolled steel sheet.

According to one embodiment of the present invention, the dent-resistant cold rolled steel sheet may have a yield point elongation in a range of greater than 0% to less than 0.2%.

According to one embodiment of the present invention, a method for manufacturing the dent-resistant cold rolled steel sheet may include the steps of: preparing a hot rolled steel sheet comprising, by weight %, 0.005% to 0.03% of carbon (C), 1.0% to 2.5% of manganese (Mn), 0.2% to 0.8% of aluminum (Al), 0.3% to 1.5% of the sum of chromium (Cr) and molybdenum (Mo), 0.001% to 0.01% of the sum of niobium (Nb) and titanium (Ti), greater than 0% to 0.02% of phosphorus (P), greater than 0% to 0.01% of sulfur (S), and the balance of iron (Fe) and other unavoidable impurities; preparing a cold rolled steel sheet by cold rolling the hot rolled steel sheet; annealing heat-treating the cold rolled steel sheet; and cooling the annealing heat-treated cold rolled steel sheet.

According to one embodiment of the present invention, the step of manufacturing the hot rolled steel sheet may include the steps of: preparing a steel material having the alloy composition; reheating the steel material in a range of 1,130° C. to 1,230° C.; preparing a hot rolled steel sheet by hot finish rolling the reheated steel material at a finish rolling end temperature of $Ar_3$ or greater; and coiling the hot rolled steel sheet in a range of 600° C. to 680° C.

According to one embodiment of the present invention, the annealing heat treatment step may be performed at an annealing temperature (Temp) for an annealing time (Time) according to Equation below.

$$3 \leq \frac{80}{\left(1+e^{0.0124(807-Temp(°C,))}\right)\left(1+e^{1/286(-8.66-Time(sec,))}\right)} \leq 30.$$

According to one embodiment of the present invention, the annealing heat treatment step may be performed by holding the cold rolled steel sheet at a temperature in a range of 780° C. to 840° C. for a time range of 30 seconds to 120 seconds.

According to one embodiment of the present invention, in the cooling step, the annealing heat-treated cold rolled steel sheet may be cooled to a temperature in a range of 0° C. to 40° C. at a cooling rate in a range of 15° C./sec to 50° C./sec.

According to one embodiment of the present invention, the dent-resistant plated steel sheet may include: a base steel sheet; and a hot-dip galvanized layer or alloyed hot-dip galvanized layer formed on the surface of the base steel sheet, wherein the base steel sheet may include, by weight %, 0.005% to 0.03% of carbon (C), 1.0% to 2.5% of manganese (Mn), 0.2% to 0.8% of aluminum (Al), 0.3% to 1.5% of the sum of chromium (Cr) and molybdenum (Mo), 0.001% to 0.01% of the sum of niobium (Nb) and titanium (Ti), greater than 0% to 0.02% of phosphorus (P), greater than 0% to 0.01% of sulfur (S), and the balance of iron (Fe) and other unavoidable impurities, and the dent-resistant plated steel sheet may have a yield strength (YP) of 195 MPa or greater, a tensile strength (TS) of 340 MPa or greater, an elongation (El) of 33% or greater, and a bake hardening amount (BH) of 40 MPa or greater.

According to one embodiment of the present invention, a method for manufacturing the dent-resistant plated steel sheet may include the steps of: preparing a hot rolled steel sheet comprising, by weight %, 0.005% to 0.03% of carbon (C), 1.0% to 2.5% of manganese (Mn), 0.2% to 0.8% of aluminum (Al), 0.3% to 1.5% of the sum of chromium (Cr) and molybdenum (Mo), 0.001% to 0.01% of the sum of niobium (Nb) and titanium (Ti), greater than 0% to 0.02% of phosphorus (P), greater than 0% to 0.01% of sulfur (S), and the balance of iron (Fe) and other unavoidable impurities; preparing a cold rolled steel sheet by cold rolling the hot rolled steel sheet; annealing heat-treating the cold rolled steel sheet; cooling the annealing heat-treated cold rolled steel sheet; hot-dip galvanizing the cooled cold rolled steel sheet; and finally cooling the hot-dip galvanized cold rolled steel sheet. The annealing heat treatment step may be performed at an annealing temperature (Temp) for an annealing time (Time) according to Equation below.

$$3 \leq \frac{80}{\left(1+e^{0.0124(807-Temp(°C,))}\right)\left(1+e^{1/286(-8.66-Time(sec,))}\right)} \leq 30.$$

According to one embodiment of the present invention, the method may further include a step of alloying heat-treating the hot-dip galvanized cold rolled steel sheet after performing the hot-dip galvanizing step.

Advantageous Effects

According to the technical spirit of the present invention, the dent-resistant cold rolled steel sheet has a microstructure in which martensite is formed in a low content of 9% or less and the average interphase distance of martensite is reduced so that martensite is uniformly dispersed. Firstly, the dent-resistant cold rolled steel sheet can manage its yield strength and elongation at the level of 340 BH, which is a general-purpose exterior steel sheet, in order to improve processing quality. Secondly, it has excellent aging resistance so that no phenomenon of increasing yield point elongation and yield strength for a period of at least one year occurs in the transportation and storage processes after production. Thirdly, it has different bake hardening behavior according to the preliminary deformation compared with the existing 340 BH steel sheet so that the bake hardenability is continuously increased when the preliminary deformation is increased. Finally, it has excellent work hardenability and bake hardenability so that the yield strength of the steel sheet after bake hardening can be increased by 60% or greater than before bake hardening. Therefore, the dent-resistant cold rolled steel sheet can provide effects of having a low yield strength before processing to increase workability, and increasing the dent resistance by bake hardening after processing.

The above-described effects of the present invention have been described exemplarily, and the scope of the present invention is not limited by these effects.

DETAILED DESCRIPTION

Figure 1:
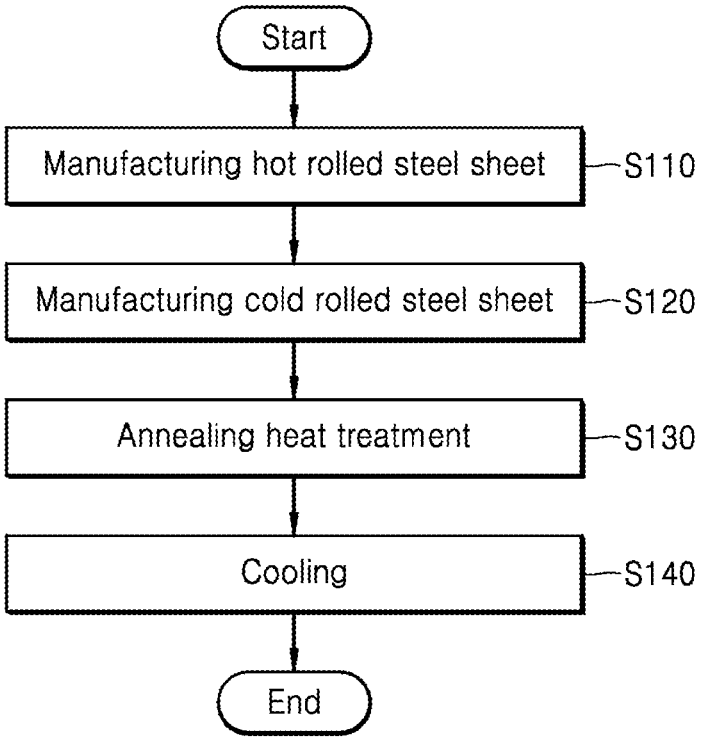
FIG. 1 is a process flowchart schematically illustrating a method for manufacturing a dent-resistant cold rolled steel sheet according to an exemplary embodiment of the present invention.

Hereinafter, preferred embodiments of the present invention will be described in detail with reference to the accompanying drawings. The embodiments of the present invention are provided to more completely explain the technical spirit of the present invention to those of ordinary skill in the art, the following embodiments may be modified in various other forms, and the scope of the technical spirit of the present invention is not limited to the following embodiments. Rather, these embodiments are provided so as to make the present disclosure more faithful and complete, and to fully convey the technical spirit of the present invention to those skilled in the art. In the present specification, the same reference numerals refer to the same elements throughout. Furthermore, various elements and regions in the drawings are schematically drawn. Accordingly, the technical spirit of the present invention is not limited by the relative size or spacing drawn in the accompanying drawings.

In order to apply it to automotive plates, particularly automotive exterior panels, the technical spirit of the present invention provides a cold rolled steel sheet which is excellent in high formability, aging resistance, and dent resistance and has no surface defects during forming by controlling the fraction, size, and position of a dual phase structure.

When a steel material having the bake hardenability is made of a ferrite single phase, there is no mechanism capable of suppressing the natural aging phenomenon in the matrix structure so that it may cause a limitation of controlling the amount of solid solution elements in the steel material to 0.0005 wt % to 0.0020 wt %, and this may increase the manufacturing difficulty of the steel material, and finally may limit the improvement of the bake hardenability and dent resistance of the parts.

Recently, dual phase steel, which has relatively low yield strength and yield ratio, has excellent work hardenability, aging resistance during transportation and storage, and bake hardenability, has been partially applied as high-strength exterior panels for automobiles. However, the elongation decreases as martensite increases in the dual phase structure, and the formability deteriorates, cracks and necking occur during press forming, and the amount of processing decreases to decrease the increase in yield strength due to work hardening so that there is a limitation in the application of exterior panels.

In the conventional art, there is a method of controlling the dual phase structure fraction to 9% or less in order to maintain the properties of dual phase steel and improve the formability thereof, and it has continuous yield behavior and low yield ratio characteristics for the application of the exterior panels. However, when such a dual phase structure fraction is small as described above, the yield strength may increase or discontinuous behavior may occur depending on the location and distribution of the dual phase structure so that it is necessary to consider the location and distribution of the dual phase structure.

Dent resistance may be related to initial yield strength, work hardening, bake hardening, and material thickness as shown in Equation 1 below.

$$\text{Dent resistance} \propto (\text{initial yield strength} + \text{work hardening} + \text{bake hardening}) \times (\text{thickness})^2 \quad \text{[Equation 1]}$$

Hereinafter, a dent-resistant cold rolled steel sheet according to the technical spirit of the present invention will be described in detail.

The dent-resistant cold rolled steel sheet according to an exemplary embodiment of the present invention includes, by weight %, 0.005% to 0.03% of carbon (C), 1.0% to 2.5% of manganese (Mn), 0.2% to 0.8% of aluminum (Al), 0.3% to 1.5% of the sum of chromium (Cr) and molybdenum (Mo), 0.001% to 0.01% of the sum of niobium (Nb) and titanium (Ti), greater than 0% to 0.02% of phosphorus (P), greater than 0% to 0.01% of sulfur (S), and the balance of iron (Fe) and other unavoidable impurities.

Hereinafter, the role and content of each component contained in the dent-resistant cold rolled steel sheet according to the present invention will be described as follows. At this time, the contents of the component elements all mean weight % with respect to the entire steel sheet.

Carbon (C): 0.005% to 0.03%

Carbon is added to secure the strength of steel, and particularly, increases the strength of a martensitic structure. Martensite, which is an iron-based dual phase structure, is produced by diffusionless transformation during rapid cooling using austenite as the parent structure, and the maximum and minimum values of the dual phase structure fraction in steel may be sensitively changed according to the change in a carbon content. When carbon is contained in an amount of less than 0.005%, it may be difficult to secure a dual phase structure fraction in a ferrite matrix of 1.0% or greater. When carbon is contained in an amount greater than 0.03%, it may be difficult to manage the dual phase structure fraction in the ferrite matrix to 9% or less since the dual phase structure fraction increases. Therefore, it is preferable to add carbon in an amount of 0.005% to 0.03% of the total weight of the steel sheet.

Manganese (Mn): 1.0% to 2.5%

When manganese is added to steel, it acts as a quenching element and contributes to the formation of a dual phase structure. When manganese is contained in an amount of less than 1.0%, it may be difficult to form the dual phase structure. When manganese is contained in an amount greater than 2.5%, the austenite fraction is rapidly changed when the annealing temperature is increased, and thus it may be greater than 9%, which is a control range of the dual phase structure fraction for realizing mechanical properties. In addition, when the manganese content is increased, non-plating and surface defects due to surface oxidation may occur. Therefore, it is preferable to add manganese in an amount of 1.0% to 2.5% of the total weight of the steel sheet.

Aluminum (Al): 0.2% to 0.8%

Aluminum plays a role of reducing the austenite transformation fraction according to temperature change in the temperature raising process during annealing. When aluminum is added, it is possible to reduce material dispersion by reducing the change in the dual phase structure fraction in the temperature raising process. When aluminum is contained in an amount of less than 0.2%, the effect of adding aluminum may be insufficient. When aluminum is contained in an amount greater than 0.8%, the annealing temperature for securing the dual phase structure may increase excessively, and thus mass productivity may decrease, and surface defects such as dents may increase as oxide foreign substances are formed during annealing. In addition, it may cause an increase in steel-making inclusions and surface oxidation phenomenon during annealing. Therefore, it is preferable to add aluminum in an amount of 0.2% to 0.8% of the total weight of the steel sheet.

Sum of Chromium (Cr) and Molybdenum (Mo): 0.3% to 1.5%

Chromium and manganese act as quenching elements and contribute to the formation of a dual phase structure. When the sum of the chromium content and the molybdenum content is less than 0.3%, the effect of adding chromium and molybdenum may be insufficient. When the sum of the chromium content and the molybdenum is greater than 1.0%, the effects may be converged and the manufacturing cost may be increased. Therefore, it is preferable to add the sum of chromium and molybdenum in an amount of 0.3% to 1.5% of the total weight of the steel sheet. In addition, it is preferable to add the sum of chromium and molybdenum in an amount of 0.3% to 1.0% of the total weight of the steel sheet.

Further, the sum of chromium and molybdenum may be controlled according to Equation 2 below.

$$0.3\text{ wt }\% \leq [Cr]+0.3[Mo] \leq 1.5\text{ wt }\% \quad \text{[Equation 2]}$$

In Equation 2, [Cr] and [Mo] are contents of chromium (Cr) and molybdenum (Mo) contained in the cold rolled steel sheet, and each unit is weight %.

Alternatively, chromium may be contained in an amount range of 0.3 wt % to 1.5 wt % of the total weight of the steel sheet. Molybdenum may be contained in an amount range of greater than 0 wt % to 0.5 wt % of the total weight of the steel sheet.

Sum of Niobium (Nb) and Titanium (Ti): 0.0010% to 0.01%

Niobium and titanium are precipitate-forming elements, and strength can be increased by a precipitation strengthening effect, and a grain refining effect can also be obtained. The present invention includes some non-ferrous dual phase particles (precipitates) in the hot rolling process, and includes a technical feature of controlling the position and distribution of iron-based dual phase particles (martensite) in the annealing process after cold rolling through hot rolling microstructure control. When niobium and titanium are added, they combine with carbon in steel to form non-ferrous dual phase particles. The larger the fraction and the smaller the size, the greater the yield strength is increased. However, in the case of automotive exterior panels with a low yield ratio, if the yield strength is excessively increased due to dual phase particles, the formability may deteriorate. When the sum of niobium and titanium is contained in an amount of less than 0.001%, the effect of addition may be insufficient. When the sum of the niobium and titanium is contained in an amount greater than 0.01%, the yield strength may be excessively increased to deteriorate the formability. Therefore, it is preferable to add the sum of niobium and titanium in an amount of 0.001% to 0.01% of the total weight of the steel sheet.

Alternatively, niobium may be contained in an amount range of 0.001 wt % to 0.01 wt % of the total weight of the steel sheet, and may be contained in an amount range of 0.001 wt % to 0.009 wt %. Titanium may be contained in an amount range of 0.001 wt % to 0.01 wt % of the total weight of the steel sheet, and may be contained in an amount range of 0.001 wt % to 0.009 wt %.

Phosphorus (P): Greater than 0% to 0.02%

Phosphorus is an impurity contained in the manufacturing process of steel, and although it can help improve strength by solid solution strengthening, low temperature brittleness may occur when it is contained in a large amount. Therefore, it is preferable to limit the phosphorus content to greater than 0% to 0.02% of the total weight of the steel sheet.

Sulfur (S): Greater than 0% to 0.01%

Sulfur is an impurity contained in the manufacturing process of steel, and may reduce bendability, toughness, and weldability by forming non-metallic inclusions such as FeS and MnS. Therefore, it is preferable to limit the sulfur content to greater than 0% to 0.01% of the total weight of the steel sheet.

Nitrogen (N): Greater than 0% to 0.006%

Nitrogen is an element that is inevitably contained in the manufacture of steel, and may help stabilize austenite, but may react with Al to form AlN, which may cause cracks during continuous casting. Therefore, it is preferable to limit the nitrogen content to greater than 0% to 0.006% of the total weight of the steel sheet.

The remaining component of the cold rolled steel sheet is iron (Fe). However, since unintended impurities from raw materials or the surrounding environment may inevitably be mixed in the normal steelmaking process, it cannot be excluded. Since these impurities are known to any person skilled in the art of a conventional manufacturing process, all contents thereof are not specifically mentioned in the present specification.

The dent-resistant cold rolled steel sheet manufactured through the manufacturing method to be described later by controlling the specific components of the aforementioned alloy composition and the content ranges thereof may satisfy, for example, a yield strength (YP) of 195 MPa or greater, a tensile strength (TS) of 340 MPa or greater, an elongation (El) of 33% or greater, and a bake hardening amount (BH) of 40 MPa or greater.

The dent-resistant cold rolled steel sheet may satisfy a yield strength (YP) of 195 MPa to 275 MPa, a tensile strength (TS) of 340 MPa to 490 MPa, an elongation (El) of 33% to 45%, and a bake hardening amount (BH) of 40 MPa to 100 MPa.

The dent-resistant cold rolled steel sheet may have a work hardening amount range of 80 MPa to 200 MPa in a strain range of 2% to 10%, which is the processing range of the automotive exterior panels. Accordingly, after bake hardening and work hardening are performed, the dent-resistant cold rolled steel sheet may have a final yield strength range of, for example, 315 MPa to 530 MPa, for example, 350 MPa to 500 MPa.

In the dent-resistant cold rolled steel sheet, no elongation at the yield point may occur or a yield point elongation range of, for example, less than 0.2%, for example, greater than 0% to less than 0.2% may be satisfied. Specifically, in the dent-resistant cold rolled steel sheet, the yield point elongation does not occur for at least one year in the transportation and storage processes after production.

The dent-resistant cold rolled steel sheet may have aging resistance at a temperature of 30° C. for, for example, 12 months or longer, for example, for a period ranging from more than 0 days to 365 days or longer than that period. The aging resistance means that even if the dent-resistant cold rolled steel sheet is stored by a method such as an outdoor loading, there is no increase in yield strength, and the yield point elongation does not occur for a period of at least one year in the transportation and storage processes after production, for example, for 1 year to 3 years.

The dent-resistant cold rolled steel sheet may include a mixed structure in which ferrite and martensite are mixed. Martensite may have a fraction range of, for example, greater than 0% to 9%, and the fraction of ferrite may be included as the remaining fraction, and may be in a range of, for example, greater than 91% to less than 100%. The fraction means an area ratio derived from the microstructure photograph through an image analyzer.

Ferrite may have an average crystal grain size in a range of 5 μm to 20 μm. When ferrite has an average crystal grain size of less than 5 μm, the elongation may be reduced. When ferrite has an average crystal grain size greater than 20 μm, a bake hardenability of 40 MPa or greater cannot be obtained.

Martensite may have an average interphase distance range of 2 μm to 5.5 μm.

The fraction and average interphase distance of martensite may be required to secure continuous yield behavior and aging resistance of low carbon steel.

The dent-resistant cold rolled steel sheet may include non-ferrous precipitates, and may include, for example, at least one of TiC, NbC, (Ti,Nb)C, TiN, NbN, and (Ti,Nb)N. The non-ferrous precipitate may have a size of, for example, 0.005 μm or greater, for example, 0.005 μm to 0.02 μm. The non-ferrous precipitate may have an average interparticle distance range of, for example, 0.05 μm or greater, for example, 0.05 μm to 0.5 μm.

The non-ferrous precipitate may provide a nucleation location of martensite by refining the hot rolled crystal grains. As the non-ferrous precipitate acts as a nucleation site, nucleation of martensite can be induced, and martensite may be formed so that the average interphase distance of martensite is controlled in an appropriate range, for example, a range of 2 μm to 5.5 μm based on the average interparticle distance of the non-ferrous precipitates. Control of the size and average interparticle distance of the non-ferrous precipitates may be required for controlling the average interphase distance of martensite.

Hereinafter, a method for manufacturing a dent-resistant cold rolled steel sheet according to the present invention will be described with reference to the accompanying drawings.

Manufacturing Method of Dent-Resistant Cold Rolled Steel Sheet

FIG. 1 is a process flowchart schematically illustrating a method for manufacturing a dent-resistant cold rolled steel sheet according to the embodiment of the present invention.

In the manufacturing method according to the present invention, the semi-finished product to be subjected to the hot rolling process may be, for example, a slab. A slab in the semi-finished state can be obtained through the continuous casting process after obtaining molten steel of a predetermined composition through the steelmaking process.

Referring to FIG. 1, the method for manufacturing a dent-resistant cold rolled steel sheet according to the embodiment of the present invention includes the steps of: preparing a hot rolled steel sheet using a steel material of the composition (S110); preparing a cold rolled steel sheet by cold rolling the hot rolled steel sheet (S120); annealing heat-treating the cold rolled steel sheet (S130); and cooling the cold rolled steel sheet (S140).

Specifically, the method may include the steps of: preparing a hot rolled steel sheet comprising, by weight %, 0.005% to 0.03% of carbon (C), 1.0% to 2.5% of manganese (Mn), 0.2% to 0.8% of aluminum (Al), 0.3% to 1.5% of the sum of chromium (Cr) and molybdenum (Mo), 0.001% to 0.01% of the sum of niobium (Nb) and titanium (Ti), greater than 0% to 0.02% of phosphorus (P), greater than 0% to 0.01% of sulfur (S), and the balance of iron (Fe) and other unavoidable impurities (S110); preparing a cold rolled steel sheet by cold rolling the hot rolled steel sheet (S120); annealing heat-treating the cold rolled steel sheet (S130); and cooling the annealing heat-treated cold rolled steel sheet (S140).

Hot Rolled Steel Sheet Manufacturing Step (S110)

A steel material having the alloy composition is prepared, and the steel material is reheated in a slab reheating temperature (SRT) range of, for example, 1,130° C. to 1,230° C. Through such reheating, redissolution of segregated components and redissolution of precipitates occurs during casting to homogenize the steel material, and the steel material may be made into a state capable of performing hot rolling. When the reheating temperature is less than 1,130° C., rolling properties are lowered in the rough rolling and finishing rolling steps, and when the rolling temperature is excessively decreased, surface defects such as cracks and excess metal may occur in the edge portion. When the reheating temperature is greater than 1,230° C., the size of austenite grains may increase, and process costs according to the temperature rise may increase. The redissolved precipitates may be re-precipitated in the rough rolling, finishing rolling, and coiling steps to refine the hot rolled crystal grain size.

A hot rolled steel sheet may be manufactured by performing hot rolling by a conventional method after the reheating, and performing hot finish rolling at a temperature of $Ar_3$ or higher, for example, a finish delivery temperature (FDT) ranging from 850° C. to 970° C. When the finish delivery temperature is less than 850° C., ferrite or pearlite may be produced. When the finish delivery temperature is greater than 970° C., scale production is increased, and the crystal grain particle diameter is coarsened so that micro-uniformization of the structure may be difficult.

Subsequently, the hot rolled steel sheet is cooled to a coiling temperature, for example, in a range of 600° C. to less than 650° C., for example, in a range of 600° C. to 680° C. The cooling may be possible by either air cooling or water cooling, and may be performed at a cooling rate of, for example, 10° C./sec to 30° C./sec. A faster cooling rate is advantageous in reducing the average crystal grain size. It is preferable to perform the cooling to the coiling temperature.

Subsequently, the hot rolled steel sheet is coiled, for example, at a coiling temperature (CT) in a range of 600° C. to less than 650° C., for example, 600° C. to 680° C. The coiling temperature range may be selected from the viewpoint of cold rolling properties and surface properties.

An object of the present invention is to refine the hot rolled crystal grain size through non-ferrous precipitates, and to allow an austenite structure, which is a parent structure of an iron-based dual phase structure such as martensite, to be evenly dispersed and produced in the cold rolling and annealing processes. The dispersed austenite structure and martensite structure uniformly disperse the dislocation density proliferation effect in ferrite to finally secure low yield ratio and aging resistance.

When the coiling temperature is less than 600° C., the non-ferrous precipitates formed by hot rolling are refined, and the distance between the non-ferrous precipitates is narrowed to increase the yield strength of the product, and thus a product of the low yield ratio properties cannot be obtained. In addition, since a hard phase such as martensite or the like is excessively produced, the material of the hot rolled steel sheet is excessively increased, and the rolling load during cold rolling may remarkably increase. When the coiling temperature is 650° C. or higher, the non-ferrous precipitates are coarsened, but the hot rolled crystal grain size increases so that the yield point elongation remains after the cold rolling and annealing processes, and thus surface defects may be caused during forming. In addition, it may lead to non-uniformity of the microstructure of the final product.

In the coiling step, the non-ferrous precipitates may be formed, the size thereof may be 0.005 μm or greater, and the distance between the non-ferrous precipitates may be 0.05 μm or greater. The non-ferrous precipitates may provide a nucleation site of martensite.

Cold Rolled Steel Sheet Manufacturing Step (S120)

The hot rolled steel sheet is subjected to a pickling treatment for washing it with an acid in order to remove the surface scale layer. Subsequently, the hot rolled steel sheet is subjected to cold rolling at an average reduction ratio of, for example, 40% to 70% to form a cold rolled steel sheet. As the average reduction ratio is greater, there is an effect of increasing the formability due to the structure refinement effect. When the average reduction ratio is less than 40%, it is difficult to obtain a uniform microstructure. When the average reduction ratio exceeds 70%, the roll force is increased to increase the process load. A thickness of the steel sheet finally produced by the cold rolling may be obtained. The structure of the cold rolled steel sheet may have a structure with a shape in which the structure of the hot rolled steel sheet is stretched.

Annealing Heat Treatment Step (S130)

The cold rolled steel sheet is annealing heat-treated in a continuous annealing furnace having a normal slow cooling section. The annealing heat treatment is performed to secure the fraction of the iron-based dual phase particle (martensite) structure and uniformly disperse it.

The annealing heat treatment may be performed at an annealing temperature (Temp) for an annealing time (Time) according to Equation 3.

$$3 \leq \frac{80}{\left(1+e^{0.0124(807-Temp(^{\circ}C,))}\right)\left(1+e^{1/286(-8.66-Time(sec,))}\right)} \leq 30. \quad \text{[Equation 3]}$$

When the process condition of the annealing heat treatment is less than 3 of Equation 3 above, the distance between martensite, which is an iron-based dual phase particle, is greater than 5.5 μm, and thus yield strength may be excessively increased. When the process condition of the annealing heat treatment is greater than 30 of Equation 3 above, the yield point elongation may be 0.2% or greater.

The annealing heat treatment may be performed by holding the cold rolled steel sheet, for example, at a temperature in a range of 780° C. to 840° C., for example, for a time in range of 30 seconds to 120 seconds, and may be performed by increasing the annealing time using Equation 3 above when annealing heat treatment is performed at a lower temperature, for example, 760° C.

When the annealing heat treatment temperature is less than 780° C., the distance between martensite, which is an iron-based dual phase particle, is greater than 5.5 μm, and the yield strength may be excessively increased. When the annealing heat treatment temperature exceeds 840° C., the yield point elongation may be 0.2% or greater.

Cooling Step (S140)

The annealing heat-treated cold rolled steel sheet is cooled at a cooling rate in a range of, for example, 15° C./sec or greater, for example, 15° C./sec to 50° C./sec. The cooling may be performed to room temperature, for example, a temperature ranging from 0° C. to 40° C. The cooling may be performed by air cooling or water cooling.

In the cooling step (S140), austenite may be transformed and formed into martensite. Accordingly, the cooling rate may have a range in which austenite is transformed into martensite.

Further, the cooling step (S140) may be performed by a multistage cooling in which rapid cooling is performed after slow cooling. For example, the annealing heat-treated cold rolled steel sheet may be slowly cooled, for example, at a cooling rate ranging from 1° C./sec to 15° C./sec, for example, to a range of 600° C. to 700° C. Subsequently, the slowly-cooled cold rolled steel sheet may be rapidly cooled, for example, at a cooling rate ranging from 15° C./sec to 50° C./sec, to room temperature, for example, a range of 0° C. to 40° C.

After performing the cooling step (S140), thermostatic treatment may be performed at a temperature ranging from 450° C. to 600° C. for 30 seconds to 200 seconds.

After performing the cooling step (S140), temper rolling may be performed with a reduction amount of, for example, 2% or less, for example, with a reduction amount ranging from 0.1% to 0.5%.

Further, the dent-resistant cold rolled steel sheet may be manufactured into a hot-dip galvanized steel sheet and an alloyed hot-dip galvanized steel sheet. In this case, the cooling step (S140) may be performed at a cooling end temperature ranging from 450° C. to 600° C. This will be described in detail below.

Microstructure of Dent-Resistant Cold Rolled Steel Sheet

Hereinafter, the microstructure of the dent-resistant cold rolled steel sheet according to the technical spirit of the present invention will be described in detail.

Figure 2:
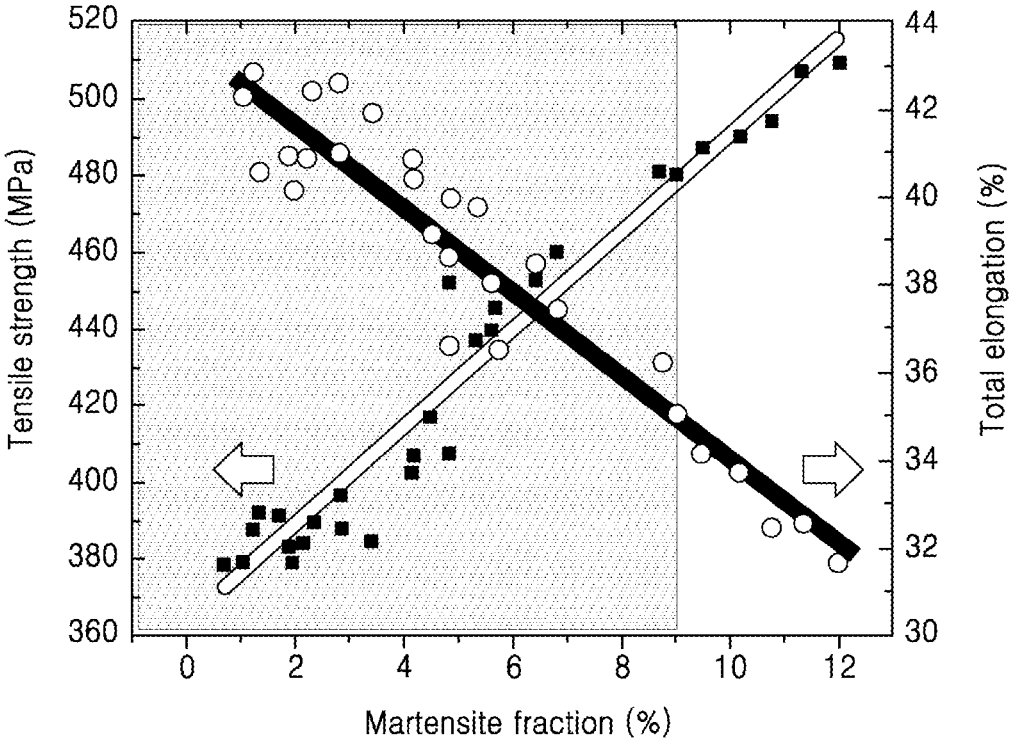
FIG. 2 is a graph showing changes in tensile strength and elongation according to the martensite fraction of a dent-resistant cold rolled steel sheet according to an exemplary embodiment of the present invention.

FIG. 2 is a graph showing changes in tensile strength and elongation according to the martensite fraction of a dent-resistant cold rolled steel sheet according to one embodiment of the present invention.

Referring to FIG. 2, when the martensite fraction increases, tensile strength increases linearly, and elongation decreases linearly. In order to satisfy the target range of tensile strength and elongation, it is preferable that the martensite fraction is 9% or less.

Figure 3:
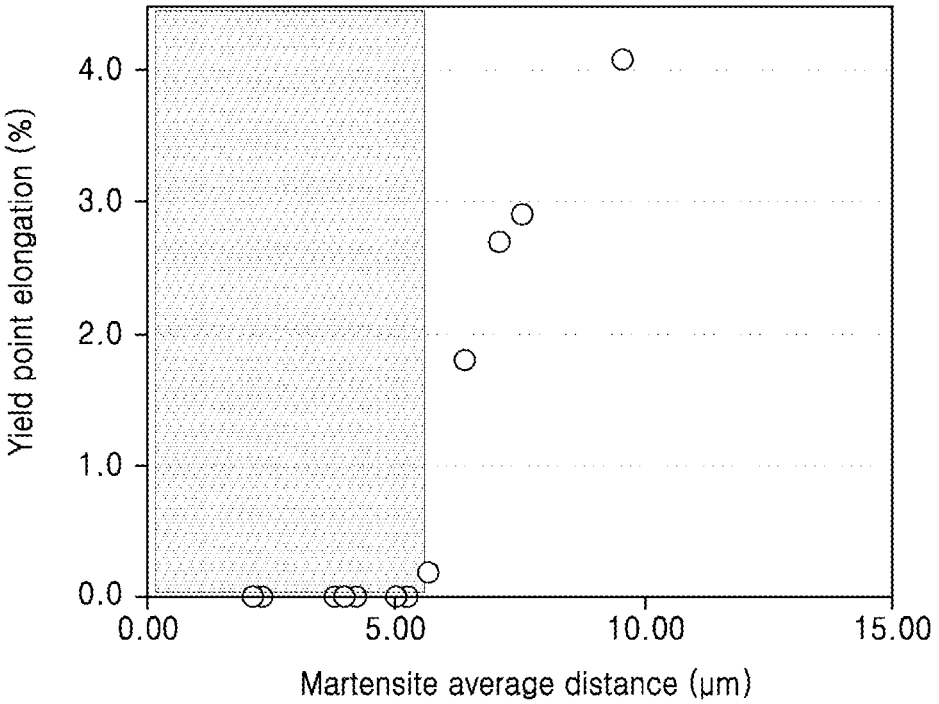
FIG. 3 is a graph showing the change in yield point elongation according to the average interphase distance of martensite of a dent-resistant cold rolled steel sheet according to an exemplary embodiment of the present invention.

FIG. 3 is a graph showing the change in yield point elongation according to the average interphase distance of martensite of a dent-resistant cold rolled steel sheet according to one embodiment of the present invention.

Referring to FIG. 3, it is a result after performing temper rolling (SPM) at a reduction ratio of 0.5% to 0.7%. When the average interphase distance of martensite was 5.5 μm or less, the yield point elongation did not appear or was appeared to be a level close to almost 0%. On the other hand, when the average interphase distance of martensite is greater than 5.5 μm, it can be seen that the yield point elongation is rapidly increased. Therefore, it is preferable that the average interphase distance of martensite is 5.5 μm or less in order to secure aging resistance and work hardenability.

Figure 4:
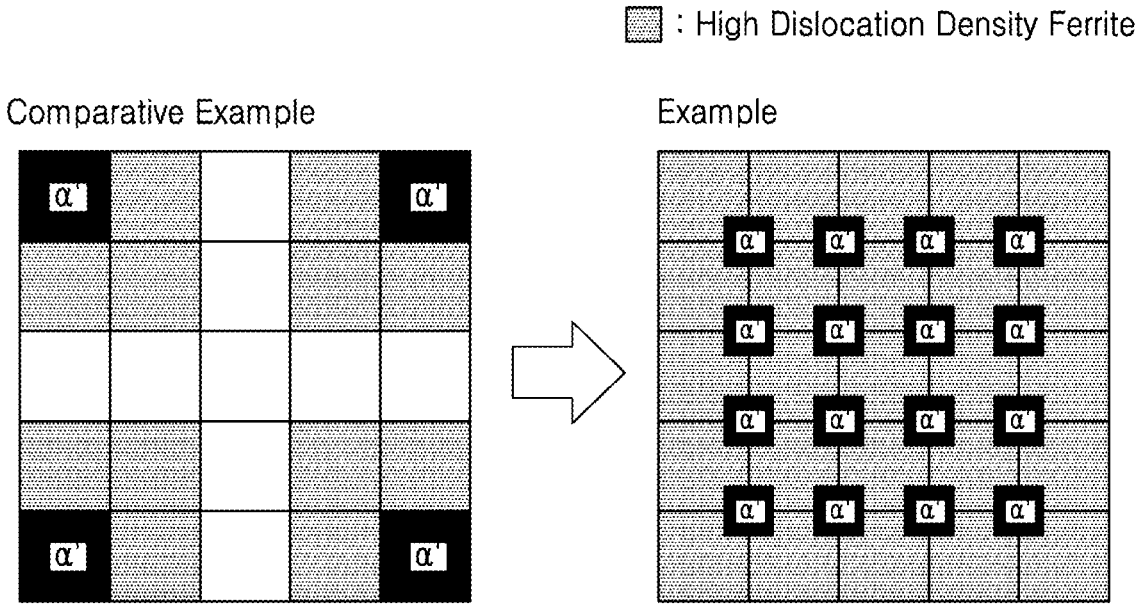
FIG. 4 is a schematic diagram showing a degree of dispersion of martensite of a dent-resistant cold rolled steel sheet according to an exemplary embodiment of the present invention.

FIG. 4 is a schematic diagram showing a degree of dispersion of martensite of a dent-resistant cold rolled steel sheet according to one embodiment of the present invention.

Referring to FIG. 4, in the case of the comparative example, when the annealing heat treatment is performed in a region outside the range of Equation 3 above, high dislocation density ferrite is non-uniformly dispersed, and accordingly, it may be formed to exceed the average interphase distance of martensite of 5.5 μm.

On the other hand, in the embodiment of the present invention, when the annealing heat treatment is performed within a range of Equation 3 above, high dislocation density ferrite is uniformly dispersed throughout, and thus it may be formed to not greater than the average interphase distance of martensite of 5.5 μm. The formation of such martensite may be implemented by uniformly forming non-ferrous precipitates having an average interparticle distance of 0.05 μm or greater throughout.

Manufacturing Method of Dent-Resistant Plated Steel Sheet

Hereinafter, a dent-resistant plated steel sheet according to the present invention and a manufacturing method thereof will be described.

A dent-resistant plated steel sheet such as a hot-dip galvanized steel sheet or an alloyed hot-dip galvanized steel sheet can be formed by using the dent-resistant plated steel sheet.

Figure 5:
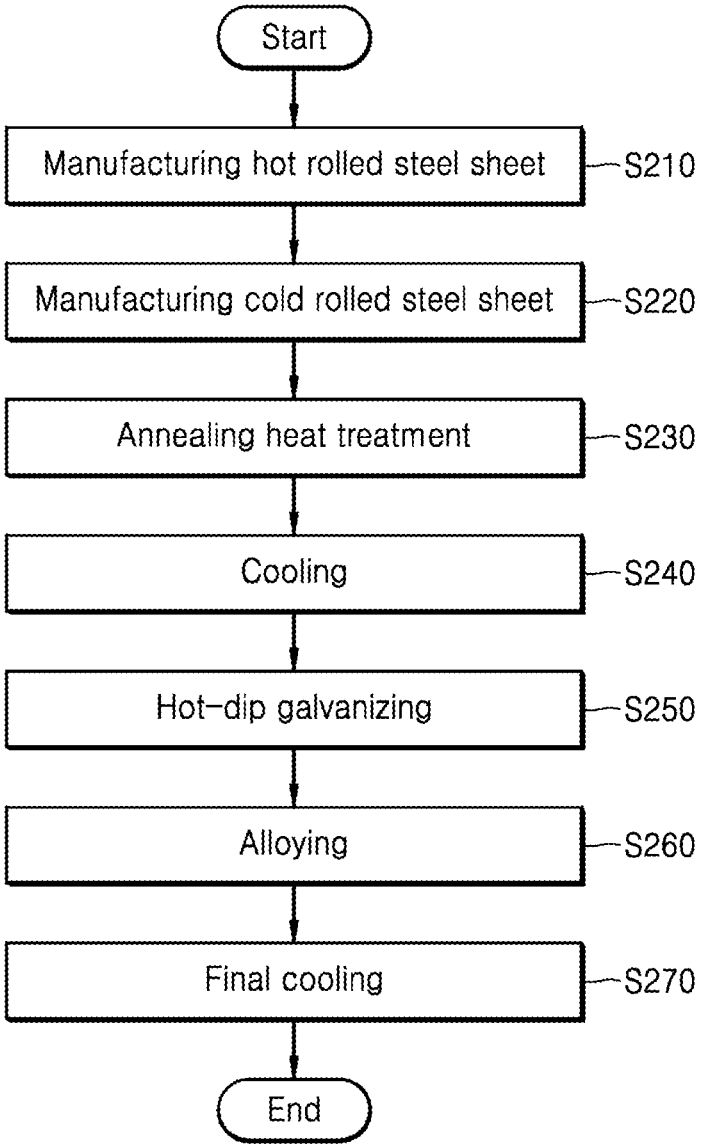
FIG. 5 is a process flowchart schematically illustrating a method for manufacturing a dent-resistant plated steel sheet according to an exemplary embodiment of the present invention.

FIG. 5 is a process flowchart schematically illustrating a method for manufacturing a dent-resistant plated steel sheet according to the embodiment of the present invention.

Referring to FIG. 5, the method for manufacturing a dent-resistant plated steel sheet according to the embodiment of the present invention includes the steps of: preparing a hot rolled steel sheet using a steel material of the composition (S210); preparing a cold rolled steel sheet by cold rolling the hot rolled steel sheet (S220); annealing heat-treating the cold rolled steel sheet (S230); cooling the cold rolled steel sheet (S240); hot-dip galvanizing the cold rolled steel sheet (S250); and finally cooling the hot-dip galvanized cold rolled steel sheet (S270).

Further, the method for manufacturing the dent-resistant plated steel sheet may further include a step (S260) of alloying heat-treating the hot-dip galvanized cold rolled steel sheet after performing the hot-dip galvanizing step (S250).

Specifically, the method for manufacturing the dent-resistant plated steel sheet may include the steps of: preparing a hot rolled steel sheet comprising, by weight %, 0.005% to 0.03% of carbon (C), 1.0% to 2.5% of manganese (Mn), 0.2% to 0.8% of aluminum (Al), 0.3% to 1.5% of the sum of chromium (Cr) and molybdenum (Mo), 0.001% to 0.01% of the sum of niobium (Nb) and titanium (Ti), greater than 0% to 0.02% of phosphorus (P), greater than 0% to 0.01% of sulfur (S), and the balance of iron (Fe) and other unavoidable impurities (S210); preparing a cold rolled steel sheet by cold rolling the hot rolled steel sheet (S220); annealing heat-treating the cold rolled steel sheet (S230); cooling the annealing heat-treated cold rolled steel sheet (S240); hot-dip galvanizing the cooled cold rolled steel sheet (S250); and finally cooling the hot-dip galvanized cold rolled steel sheet to a temperature range of 0° C. to 40° C. (S270).

Further, the method for manufacturing the ultra-high strength plated steel sheet may further include a step (S260) of alloying heat-treating the hot-dip galvanized cold rolled steel sheet after performing the hot-dip galvanizing step (S250).

The hot rolled steel sheet manufacturing step (S210) may be the same as the above-described hot rolled steel sheet manufacturing step (S110). The cold rolled steel sheet manufacturing step (S220) may be the same as the above-described cold rolled steel sheet manufacturing step (S120). The annealing heat treatment step (S230) may be the same as the above-described annealing heat treatment step (S130).

Cooling Step (S240)

In the cooling step (S240), the annealing het-treated cold rolled steel sheet is cooled. The annealing het-treated cold rolled steel sheet is cooled, for example, at a cooling rate in a range of 1° C./sec to 10° C./sec, for example, to a cooling end temperature of 450° C. to 600° C. In the case of the plated steel sheet, there is a difference in that the cooling end temperature is higher than that of the above-described cold rolled steel sheet.

When the cooling end temperature is less than 450° C., the steel sheet temperature is lowered, and thus dross may be generated in a galvanizing bath during galvanizing. When the cooling end temperature is greater than 600° C., the temperature of the galvanizing bath increases, and thus an accident may occur.

Hot-Dip Salvanizing Step (S250)

In the hot-dip galvanizing step (S250), the cooled cold rolled steel sheet is immersed in a hot-dip galvanizing bath at a temperature, for example, in a range of 450° C. to 600° C. to form a hot-dip galvanized layer on the surface of the cold rolled steel sheet, and thus a hot-dip galvanized steel sheet may be formed. The hot-dip galvanizing step may be performed by, for example, holding the cold rolled steel sheet for a time in a range of 30 seconds to 200 seconds.

Alloying Heat Treatment Step (S260)

An alloyed hot-dip galvanized steel sheet may be formed by subjecting the hot-dip galvanized steel sheet to an alloying heat treatment, for example, at a temperature in a range of 490° C. to 630° C., for example, for a time in a range of 10 seconds to 60 seconds. The alloying heat treatment step (S260) may be performed continuously without performing cooling after performing the previous hot-dip galvanizing step (S250). As the hot-dip galvanized layer is stably grown during the alloying heat treatment under the above conditions, the close adhesion properties of the plating layer may be excellent. When the alloying heat treatment temperature is less than 490° C., the soundness of the hot-dip galvanized layer may deteriorate since alloying does not proceed sufficiently. When the alloying heat treatment temperature is longer than 630° C., material changes may occur while the temperature is passing to a dual phase temperature section.

Final Cooling Step (S270)

In the final cooling step (S270), the hot-dip galvanized cold rolled steel sheet, that is, the hot-dip galvanized steel sheet or alloyed hot-dip galvanized steel sheet is cooled to room temperature, for example, a temperature in a range of 0° C. to 40° C. The cooling may be performed by air cooling or water cooling. The cooling is performed, for example, at a cooling rate of 15° C./sec or greater, for example, at a cooling rate in a range of 15° C./sec to 50° C./sec.

In the final cooling step (S270), austenite may be transformed and formed into martensite. Accordingly, the cooling rate may have a range in which austenite is transformed into martensite.

After performing the final cooling step (S270), thermostatic treatment may be performed at a temperature ranging from 450° C. to 600° C. for 30 seconds to 200 seconds.

The dent-resistant plated steel sheet formed by the above-described manufacturing method may include: a base steel sheet; and a hot-dip galvanized layer or alloyed hot-dip galvanized layer formed on the surface of the base steel sheet. The base steel sheet may include, by weight %, 0.005% to 0.03% of carbon (C), 1.0% to 2.5% of manganese (Mn), 0.2% to 0.8% of aluminum (Al), 0.3% to 1.5% of the sum of chromium (Cr) and molybdenum (Mo), 0.001% to 0.01% of the sum of niobium (Nb) and titanium (Ti), greater than 0% to 0.02% of phosphorus (P), greater than 0% to 0.01% of sulfur (S), and the balance of iron (Fe) and other unavoidable impurities, and satisfy a yield strength (YP) of 195 MPa or greater, a tensile strength (TS) of 340 MPa or greater, an elongation (El) of 33% or greater, and a bake hardening amount (BH) of 40 MPa or greater.

The dent-resistant plated steel sheet may have physical properties and microstructure characteristics of the dent-resistant cold rolled steel sheet as described above.

Experimental Example

Hereinafter, a preferred experimental example is presented to help the understanding of the present invention. However, the following experimental example is only for helping understanding of the present invention, and the present invention is not limited by the following experimental example.

Steels having the compositions (unit: weight %) shown in Table 1 below were prepared, and cold rolled steel sheets according to Examples and Comparative Examples were prepared through predetermined hot rolling and cold rolling processes and heat treatment processes. The balance is iron (Fe).

TABLE 1

| Classification | C | Mn | Al | Cr + Mo | Nb + Ti | P | S |
|---|---|---|---|---|---|---|---|
| Comparative Example 1 | 0.002 | 0.5 | 0.03 | 0 | 0.01 | 0.005 | 0.003 |
| Comparative Example 2 | 0.005 | 1.2 | 0.03 | 0 | 0.056 | 0.005 | 0.003 |
| Comparative Example 3 | 0.060 | 1.2 | 0.03 | 0 | 0.005 | 0.005 | 0.003 |
| Comparative Example 4 | 0.040 | 0.3 | 0.03 | 0 | 0.016 | 0.005 | 0.003 |
| Comparative Example 5 | 0.040 | 1.6 | 0.4 | 0.5 | 0.005 | 0.005 | 0.003 |
| Comparative Example 6 | 0.020 | 0.9 | 0.4 | 0.2 | 0.005 | 0.005 | 0.003 |
| Comparative Example 7 | 0.020 | 1.6 | 0.4 | 0.5 | 0 | 0.005 | 0.003 |
| Comparative Example 8 | 0.020 | 1.6 | 0.4 | 0.5 | 0.005 | 0.005 | 0.003 |
| Comparative Example 9 | 0.020 | 1.6 | 0.4 | 0.5 | 0.005 | 0.005 | 0.003 |
| Comparative Example 10 | 0.020 | 1.6 | 0.4 | 0.5 | 0.005 | 0.005 | 0.003 |
| Comparative Example 11 | 0.020 | 1.6 | 0.4 | 0.5 | 0.005 | 0.005 | 0.003 |
| Example 1 | 0.020 | 1.6 | 0.4 | 0.5 | 0.005 | 0.005 | 0.003 |
| Example 2 | 0.020 | 1.6 | 0.4 | 0.5 | 0.005 | 0.005 | 0.003 |
| Example 3 | 0.030 | 1.6 | 0.4 | 0.5 | 0.005 | 0.005 | 0.003 |
| Example 4 | 0.020 | 1.6 | 0.4 | 0.5 | 0.005 | 0.005 | 0.003 |

Referring to Table 1, Examples and Comparative Examples 8 to 11 satisfied the composition ranges of the present invention.

Comparative Example 1 had a difference in that the contents of carbon, manganese, and aluminum were less than the lower limits of the composition ranges of the present invention, and chromium and molybdenum were not contained. Comparative Example 2 had a difference in that the content of aluminum was less than the lower limit of the composition range of the present invention, and chromium and molybdenum were not contained. Comparative Example 3 had a difference in that the content of carbon was higher than the upper limit of the composition range of the present invention, the content of aluminum was less than the lower limit of the composition range of the present invention, and chromium and molybdenum were not contained. Comparative Example 4 had a difference in that the content of carbon was greater than the upper limit of the composition range of the present invention, the contents of manganese and aluminum were less than the lower limits of the composition ranges of the present invention, and chromium and molybdenum were not contained. Comparative Example 5 had a difference in that the content of carbon was greater than the upper limit of the composition range of the present invention. Comparative Example 6 had a difference in that the content of manganese was less than the lower limit of the composition range of the present invention, and the sum of chromium and molybdenum was less than the lower limit of the composition range of the present invention. Comparative Example 7 had a difference in that niobium and titanium are not contained.

Table 2 shows the values of the heat treatment process conditions for manufacturing the cold rolled steel sheets of Comparative Examples and Examples.

TABLE 2

| Classification | Coiling temperature (° C.) | Value of Equation 3 |
|---|---|---|
| Comparative Example 1 | 640 | 32 |
| Comparative Example 2 | 640 | 25 |
| Comparative Example 3 | 640 | 16 |
| Comparative Example 4 | 640 | 16 |
| Comparative Example 5 | 640 | 16 |
| Comparative Example 6 | 640 | 16 |
| Comparative Example 7 | 640 | 2 |
| Comparative Example 8 | 640 | 32 |
| Comparative Example 9 | 580 | 1 |
| Comparative Example 10 | 730 | 16 |
| Comparative Example 11 | 640 | 1 |
| Example 1 | 640 | 16 |
| Example 2 | 640 | 5 |
| Example 3 | 640 | 16 |
| Example 4 | 640 | 16 |

Referring to Table 2, Examples and Comparative Examples 2 to 6 satisfied the process conditions of the present invention.

Comparative Example 9 had a lower coiling temperature than the lower limit of the coiling temperature of the present invention, and Comparative Example 10 had a higher coiling temperature than the upper limit of the coiling temperature. Comparative Example and Comparative Example 8 had greater values than the upper limit of Equation 3 above. Comparative Example 7, Comparative Example 9, and Comparative Example 11 had less values than the lower limit of Equation 3 above.

Table 3 shows yield strength (YS), tensile strength (TS), elongation (EL), bake hardening amount (BH), and yield point elongation as physical and mechanical properties of the above-mentioned manufactured cold rolled steel sheets.

TABLE 3

| Classification | Yield strength (MPa) | Tensile strength (MPa) | Elongation (%) | Bake hardening amount (MPa) | Yield point elongation (%) |
|---|---|---|---|---|---|
| Comparative Example 1 | 234 | 362 | 42 | 35 | 0.3 |
| Comparative Example 2 | 301 | 447 | 36 | 0 | 0.7 |
| Comparative Example 3 | 298 | 440 | 32 | 44 | 1.3 |
| Comparative Example 4 | 322 | 398 | 36 | 47 | 0.8 |
| Comparative Example 5 | 288 | 529 | 31 | 53 | 0 |
| Comparative Example 6 | 280 | 379 | 42 | 42 | 2.0 |
| Comparative Example 7 | 278 | 388 | 40 | 43 | 1.8 |
| Comparative Example 8 | 260 | 416 | 39 | 47 | 0.3 |

TABLE 3-continued

| Classification | Yield strength (MPa) | Tensile strength (MPa) | Elongation (%) | Bake hardening amount (MPa) | Yield point elongation (%) |
|---|---|---|---|---|---|
| Comparative Example 9 | 299 | 432 | 34 | 54 | 0.8 |
| Comparative Example 10 | 205 | 374 | 39 | 48 | 0.2 |
| Comparative Example 11 | 288 | 378 | 40 | 47 | 1.6 |
| Example 1 | 262 | 384 | 39 | 51 | 0 |
| Example 2 | 236 | 427 | 38 | 52 | 0 |
| Example 3 | 274 | 488 | 35 | 49 | 0 |
| Example 4 | 244 | 444 | 36 | 47 | 0 |

Referring to Table 3, the Examples satisfied the target ranges with respect to the yield strength (YS), tensile strength (TS), elongation (EL), bake hardening amount, and yield point elongation.

When examining the yield point elongation, Comparative Examples 1 to 4 and Comparative Examples 6 to 11 showed yield point elongation values of 0.2% or greater as higher values than the upper limit of the target range of the present invention.

When examining the yield strength, Comparative Examples 2 to 7, Comparative Example 9, and Comparative Example 11 showed yield strength values exceeding 275 MPa as values higher than the upper limit of the target range of the present invention.

Further, Comparative Example 5 showed the tensile strength that was higher than the upper limit of the target range of the present invention, and the elongation that was lower than the lower limit of the target range of the present invention. Comparative Examples 1 and 2 showed the baking hardening amount values lower than the lower limit of the target range of the present invention.

Table 4 shows factions of martensite, average interphase distances, and sizes and average interparticle distances of non-ferrous precipitates in the microstructures of the manufactured cold-rolled steel sheets.

TABLE 4

| | Martensite | | Non-ferrous precipitates | |
|---|---|---|---|---|
| Classification | Fraction (%) | Average interphase distance (μm) | Size (μm) | Average interparticle distance (μm) |
| Comparative Example 1 | 0 | — | 0.004 | 0.08 |
| Comparative Example 2 | 0 | — | 0.002 | 0.01 |
| Comparative Example 3 | 0 | — | 0.005 | 0.11 |
| Comparative Example 4 | 0 | — | 0.005 | 0.11 |

TABLE 4-continued

| | Martensite | | Non-ferrous precipitates | |
|---|---|---|---|---|
| Classification | Fraction (%) | Average interphase distance (μm) | Size (μm) | Average interparticle distance (μm) |
| Comparative Example 5 | 15.6 | 2.12 | 0.005 | 0.11 |
| Comparative Example 6 | 0.7 | 9.53 | 0.005 | 0.11 |
| Comparative Example 7 | 1.9 | 6.39 | — | — |
| Comparative Example 8 | 4.9 | 6.20 | 0.005 | 0.11 |
| Comparative Example 9 | 6.2 | 2.60 | 0.002 | 0.04 |
| Comparative Example 10 | 2.2 | 6.80 | 0.007 | 0.13 |
| Comparative Example 11 | 0.6 | 7.10 | 0.005 | 0.11 |
| Example 1 | 1.8 | 5.08 | 0.005 | 0.11 |
| Example 2 | 4.6 | 3.83 | 0.005 | 0.11 |
| Example 3 | 9.5 | 2.27 | 0.005 | 0.11 |
| Example 4 | 6.0 | 5.00 | 0.005 | 0.11 |

Referring to Table 4, the Examples satisfied the target ranges with respect to the fraction and size of martensite and the fraction and size of non-ferrous precipitates.

In Comparative Examples 1 to 4, martensite, which is an iron-based dual phase particle, was not observed. In addition, in Comparative Example 1 and Comparative Example 2, the non-ferrous precipitate, which is a non-ferrous dual phase particle, was shown to have a small size. It is analyzed that they had high yield point elongations due to such microstructures.

Comparative Example 5 showed the martensite fraction greater than the upper limit of the target range of the present invention. It is analyzed that it had a high tensile strength and a low elongation due to such a microstructure.

Comparative Examples 6 and 11 showed the martensite fractions less than the lower limit of the target range of the present invention, and showed the average interphase distances of martensite higher than the upper limit of the target range of the present invention. It is analyzed that they have high yield strength and high yield point elongation due to such microstructures.

Comparative Example 7, Comparative Example 8, and Comparative Example 10 showed the average interphase distances of martensite higher than the upper limit of the target range of the present invention. It is analyzed that they have high yield strength and high yield point elongation due to such microstructures.

Comparative Example 9 showed the size of the non-ferrous precipitates and the average interparticle distance less than the lower limits of the target ranges of the present invention. It is analyzed that it had high yield strength and high yield point elongation due to such a microstructure.

Table 5 shows changes in the yield strength due to work hardening and bake hardening of the above-mentioned manufactured cold-rolled steel sheets.

TABLE 5

| Classification | Preliminary deformation | Initial yield strength (MPa) | Work hardening amount (MPa) | Bake hardening amount (MPa) | Total increase in yield strength (MPa) | Final yield strength (MPa) | Yield strength increase rate (%) |
|---|---|---|---|---|---|---|---|
| Comparative | 0 | 234 | 0 | 3 | 3 | 236 | 1 |
| Example 1 | 0.5 | 234 | 5 | 31 | 36 | 270 | 16 |
| (Carbon | 1.0 | 234 | 25 | 31 | 56 | 290 | 24 |
| content | 2.0 | 234 | 43 | 29 | 72 | 306 | 31 |
| 0.002%) | 2.5 | 234 | 55 | 28 | 83 | 317 | 36 |

TABLE 5-continued

| Classification | Preliminary deformation | Initial yield strength (MPa) | Work hardening amount (MPa) | Bake hardening amount (MPa) | Total increase in yield strength (MPa) | Final yield strength (MPa) | Yield strength increase rate (%) |
|---|---|---|---|---|---|---|---|
| | 4.0 | 234 | 74 | 29 | 103 | 337 | 44 |
| | 7.0 | 234 | 98 | 24 | 122 | 356 | 52 |
| | 10.0 | 234 | 114 | 24 | 138 | 372 | 59 |
| Example 5 | 0 | 244 | 0 | 15 | 15 | 259 | 6 |
| (Carbon | 0.5 | 244 | 12 | 41 | 53 | 287 | 22 |
| content | 1.0 | 244 | 27 | 49 | 76 | 310 | 31 |
| 0.02%) | 2.0 | 244 | 57 | 47 | 104 | 338 | 43 |
| | 2.5 | 244 | 100 | 50 | 150 | 384 | 62 |
| | 4.0 | 244 | 132 | 47 | 179 | 413 | 74 |
| | 7.0 | 244 | 181 | 57 | 238 | 472 | 98 |
| | 10.0 | 244 | 191 | 55 | 246 | 480 | 101 |

Referring to Table 5, exemplary results are shown for the steel sheet of Comparative Example 1 and the steel sheet of Example 4. Compared to Comparative Example 1, Example 4 showed a large bake hardening amount with respect to the same preliminary deformation, accordingly, the amount of increase in yield strength was also increased, and as a result, the final yield strength after baking hardening was shown to be high. Accordingly, it can be seen that the dent resistance was increased.

The technical spirit of the present invention described above is not limited to the above-described Examples and the accompanying drawings, and it will be apparent to those with ordinary skill in the art to which the technical spirit of the present invention pertains that various substitutions, modifications and changes are possible within the scope without departing from the technical spirit of the present invention.

What is claimed:

1. A dent-resistant cold rolled steel sheet, comprising, by weight %, 0.005% to 0.03% of carbon (C), 1.0% to 2.5% of manganese (Mn), 0.2% to 0.8% of aluminum (Al), 0.3% to 1.5% of the sum of chromium (Cr) and molybdenum (Mo), 0.001% to 0.01% of the sum of niobium (Nb) and titanium (Ti), greater than 0% to 0.02% of phosphorus (P), greater than 0% to 0.01% of sulfur (S), and the balance of iron (Fe) and other unavoidable impurities, and wherein the dent-resistant cold rolled steel sheet has a yield strength (YP) of 195 MPa or greater, a tensile strength (TS) of 340 MPa or greater, an elongation (El) of 33% or greater, and a bake hardening amount (BH) of 40 MPa or greater, wherein the dent-resistant cold rolled steel sheet comprises a mixed structure in which ferrite and martensite are mixed, wherein the martensite has an average interphase distance therebetween in a range of 2 μm to 5.5 μm, wherein the dent-resistant cold rolled steel sheet comprises non-ferrous precipitates, and the non-ferrous precipitates have an average interparticle distance of 0.05 μm or greater.

2. The dent-resistant cold rolled steel sheet of claim 1, wherein the sum of chromium and molybdenum is controlled according to the following Equation:

$$0.3 \text{ wt } \% \leq [Cr]+0.3[Mo] \leq 1.5 \text{ wt } \%.$$

3. The dent-resistant cold rolled steel sheet of claim 1, wherein a fraction of the martensite is in a range of greater than 0% to 9%, and the ferrite constitutes the remaining fraction.

4. The dent-resistant cold rolled steel sheet of claim 1, wherein the ferrite has an average crystal grain size in a range of 5 μm to 20 μm.

5. The dent-resistant cold rolled steel sheet of claim 1, wherein the dent-resistant cold rolled steel sheet has a yield strength (YP) of 195 MPa to 275 MPa, a tensile strength (TS) of 340 MPa to 490 MPa, an elongation (El) of 33% to 45%, and a bake hardening amount (BH) of 40 MPa to 55 MPa.

6. The dent-resistant cold rolled steel sheet of claim 1, wherein the dent-resistant cold rolled steel sheet satisfies a work hardening amount of 80 MPa to 200 MPa in a strain range of 2% to 10%.

7. The dent-resistant cold rolled steel sheet of claim 1, wherein the dent-resistant cold rolled steel sheet has a final yield strength in a range of 350 MPa to 500 MPa after baking hardening and work hardening are performed.

8. The dent-resistant cold rolled steel sheet of claim 1, wherein the yield point elongation does not occur in the dent-resistant cold rolled steel sheet.

9. The dent-resistant cold rolled steel sheet of claim 1, wherein the dent-resistant cold rolled steel sheet has a yield point elongation in a range of greater than 0% to less than 0.2%.

10. A method for manufacturing the dent-resistant cold rolled steel sheet of claim 1, the method comprising the steps of:

preparing a steel material hot rolled steel sheet comprising, by weight %, 0.005% to 0.03% of carbon (C), 1.0% to 2.5% of manganese (Mn), 0.2% to 0.8% of aluminum (Al), 0.3% to 1.5% of the sum of chromium (Cr) and molybdenum (Mo), 0.001% to 0.01% of the sum of niobium (Nb) and titanium (Ti), greater than 0% to 0.02% of phosphorus (P), greater than 0% to 0.01% of sulfur(S), and the balance of iron (Fe) and other unavoidable impurities;

reheating the steel material in a range of 1130° C. to 1230° C.;

preparing a hot rolled steel sheet by hot finish rolling the reheated steel material at a finish rolling end temperature of Ar3 or higher;

coiling the hot rolled steel sheet in a range of 600° C. to less than 650° C.;

preparing a cold rolled steel sheet by cold rolling the hot rolled steel sheet;

annealing heat-treating the cold rolled steel sheet; and cooling the annealing heat-treated cold rolled steel sheet, wherein the annealing heat treatment step is performed at an annealing temperature (Temp) for an annealing time (Time) according to the following Equation:

$$3 \leq \frac{80}{\left(1+e^{0.0124(807-Temp(^{\circ}C,))}\right)\left(1+e^{1/286(-8.66-Time(sec,))}\right)} \leq 30.$$

thereby producing the dent-resistant plated steel sheet of claim 1.

11. The method of claim 10, wherein the annealing heat treatment step is performed by holding the cold rolled steel sheet at a temperature in a range of 780° C. to 840° C. for a time range of 30 seconds to 120 seconds.

12. The method of claim 10, wherein, in the cooling step, the annealing heat-treated cold rolled steel sheet is cooled to a temperature in a range of 0° C. to 40° C. at a cooling rate in a range of 15° C./sec to 50° C./sec.

13. A dent-resistant plated steel sheet comprising:

a base steel sheet; and a hot-dip galvanized layer or alloyed hot-dip galvanized layer formed on the surface of the base steel sheet, wherein the base steel sheet comprises, by weight %, 0.005% to 0.03% of carbon (C), 1.0% to 2.5% of manganese (Mn), 0.2% to 0.8% of aluminum (Al), 0.3% to 1.5% of the sum of chromium (Cr) and molybdenum (Mo), 0.001% to 0.01% of the sum of niobium (Nb) and titanium (Ti), greater than 0% to 0.02% of phosphorus (P), greater than 0% to 0.01% of sulfur(S), and the balance of iron (Fe) and other unavoidable impurities, and the base steel sheet has a yield strength (YP) of 195 MPa or greater, a tensile strength (TS) of 340 MPa or greater, an elongation (El) of 33% or greater, and a bake hardening amount (BH) of 40 MPa or greater wherein the dent-resistant cold rolled steel sheet comprises a mixed structure in which ferrite and martensite are mixed, wherein the martensite has an average interphase distance therebetween in a range of 2 μm to 5.5 μm, wherein the dent-resistant cold rolled steel sheet comprises non-ferrous precipitates, and the non-ferrous precipitates have an average interparticle distance of 0.05 μm or greater.

14. A method for manufacturing the dent-resistant plated steel sheet of claim 13, the method comprising the steps of:

preparing a steel material comprising, by weight %, 0.005% to 0.03% of carbon (C), 1.0% to 2.5% of manganese (Mn), 0.2% to 0.8% of aluminum (Al), 0.3% to 1.5% of the sum of chromium (Cr) and molybdenum (Mo), 0.001% to 0.01% of the sum of niobium (Nb) and titanium (Ti), greater than 0% to 0.02% of phosphorus (P), greater than 0% to 0.01% of sulfur (S), and the balance of iron (Fe) and other unavoidable impurities;

reheating the steel material in a range of 1130° C. to 1230° C.;

preparing a hot rolled steel sheet by hot finish rolling the reheated steel material at a finish rolling end temperature of Ar3 or higher;

coiling the hot rolled steel sheet in a range of 600° C. to less than 650° C.;

preparing a cold rolled steel sheet by cold rolling the hot rolled steel sheet;

annealing heat-treating the cold rolled steel sheet;

cooling the annealing heat-treated cold rolled steel sheet;

hot-dip galvanizing the cooled cold rolled steel sheet; and finally cooling the hot-dip galvanized cold rolled steel sheet, wherein the annealing heat treatment step is performed at an annealing temperature (Temp) for an annealing time (Time) according to the following Equation:

$$3 \leq \frac{80}{\left(1+e^{0.0124(807-Temp(^{\circ}C,))}\right)\left(1+e^{1/286(-8.66-Time(sec,))}\right)} \leq 30.$$

thereby producing the dent-resistant plated steel sheet of claim 13.

15. The method of claim 14, further comprising a step of alloying heat-treating the hot-dip galvanized cold rolled steel sheet after performing the hot-dip galvanizing step.

* * * * *